United States Patent [19]

Kellner et al.

[11] Patent Number: 4,522,234

[45] Date of Patent: Jun. 11, 1985

[54] MULTIPLE CONDUIT DRILL PIPE

[75] Inventors: Jackson M. Kellner, Midland; William R. Garrett, Houston, both of Tex.

[73] Assignee: Smith International Inc., Newport Beach, Calif.

[21] Appl. No.: 333,136

[22] Filed: Dec. 21, 1981

Related U.S. Application Data

[60] Continuation of Ser. No. 100,757, Dec. 6, 1979, abandoned, which is a continuation of Ser. No. 859,049, Dec. 9, 1977, abandoned, which is a continuation of Ser. No. 718,370, Aug. 27, 1976, abandoned, which is a division of Ser. No. 643,254, Dec. 22, 1975, Pat. No. 4,040,495.

[51] Int. Cl.[3] ..... F16L 39/00; E21B 1/06

[52] U.S. Cl. ..... 138/108; 138/111; 138/113; 138/148; 285/133 R; 339/16 C; 339/16 R

[58] Field of Search ..... 138/108, 111, 112, 113, 138/114, 148, 178; 277/92, DIG. 9; 285/133 R, 319, 134, 136, 133 A; 339/16 R, 16 C; 175/215, 321, 73, 320; 64/11 R

[56] References Cited

U.S. PATENT DOCUMENTS

| | | | |
|---|---|---|---|
| 2,519,933 | 8/1950 | Rouault | 339/16 C X |
| 3,033,011 | 5/1962 | Garrett | 64/11 R |
| 3,471,177 | 10/1969 | Garrett et al. | 285/133 R |
| 3,583,502 | 6/1971 | Henderson | 175/215 X |
| 3,970,335 | 7/1976 | Curington et al. | 285/133 A |
| 4,039,237 | 8/1977 | Cullen et al. | 339/16 R X |

*Primary Examiner*—James E. Bryant, III

[57] ABSTRACT

Pipe comprising intermediate tube radially spaced between outer and inner tubes, a support adjacent one end of inner tube fixedly mounting intermediate tube to outer and inner tubes and a shock mount adjacent the other end of intermediate tube fixedly attached to the intermediate tube positioning intermediate tube between inner and outer tubes and including a resilient part providing for limited relative axial and rotational movement between intermediate tube and outer tube at said second support, said resilient part having lower modulus of elasticity than said first support and being elastomeric to damp out relative rotational vibrations of said tubes through its internal friction, threaded portions on ends of outer tube for making mechanical connection with correlative threaded portions on ends of outer tube of similar pipe, telescopic portions on ends of intermediate tube for making fluid conducting connection with correlative portions on ends of intermediate tube of similar pipe, pin and socket on ends of inner tube for making electrical connection with correlative socket and pin on ends of inner tube of similar pipe, and electric conduit within inner tube connecting said pin and socket, said threaded portions including shoulders limiting make up with correlative shoulders on ends of outer tube of similar pipe, said telescopic portions and pin and socket providing for limited axial motion of inner and intermediate tubes of the pipe with respect to those of similar pipes when said threaded portions are fully made up with correlative threaded portions on similar pipe.

17 Claims, 10 Drawing Figures

MULTIPLE CONDUIT DRILL PIPE

This is a continuation of application Ser. No. 100,757 filed 12-6-79, now abandoned which was a continuation of application Ser. No. 859,049, filed 12-9-77, now abandoned which was a continuation of application Ser. No. 718,370 filed 8-27-76 now abandoned which was a division of Ser. No. 643,254 filed 12-22-75 now U.S. Pat. No. 4,040,495.

BACKGROUND OF THE INVENTION

1. Field of Invention

This invention pertains to earth boring and more particularly to drill directing apparatus, especially multiple conduit drill pipe employed therewith.

2. Description of Prior Art

It is known to drill a hole in the earth with a rotating bit. In such drilling the bit may be loaded axially either by the weight of the drill stem to which the bit is connected or by application of fluid pressure to a piston or cylinder connected to the drill stem anywhere along its length between the bit and the mouth of the hole. The bit can be rotated by a motor connected to the drill stem anywhere between its inner end adjacent the bit and its other or outer end, which may be out of the hole at the earth's surface. It is known to guide the bit to cause the hole to be bored in any desired direction. Instead of fixing the barrel in the hole and drilling through it, it is also known to provide bit deflection means affixed to the bit or to the drill stem adjacent the bit, such deflection means moving axially in the hole as the bit proceeds.

To take the reaction force of an in-hole bit loading device, an in-hole motor or a bit directing device, it is known to provide anchor means to engage the wall of the hole being drilled. This is shown, for example, in U.S. Pat. No. 556,718, to Semmer which also shows means for advancing an in-hole motor and bit loading device along the hole as it is drilled.

It is also known in the art to orient the pipe from outside the hole as in U.S. Pat. No. 3,561,549 to Garrison et al.

It is also known in the art to transmit electrical data from the hole to the surface, including the use of special pipe to transmit hydraulic fluid and electrical signals. Pat. No. 556,718, issued Mar. 17, 1896, to P. Semmer; U.S. Pat. No. 3,170,137, issued Feb. 16, 1965, to H. Brandt;

It is also known to mount two or three pipes concentrically with supports and including various types of expansion joints.

Applicant also understands that at one time Shell encountered difficulty with floating vessel axial risers and constructed pipe to leave one end of each length of the inner tube free.

It is also known to centralize or prevent skewing by the drill bit in the hole. See. U.S. Pat. No. 3,088,532.

SUMMARY OF THE INVENTION

According to the invention, a deflection barrel is disposed about and fixedly attached to the housing of an in-hole bit driving motor is connected to a string of pipe, connected at its outer end to an out-hole orientation and axial force application means for turning the barrel as desired relative to the hole and applying axial force to the bit, and supplying fluid to drive the motor and carry away the detritus. Means to give a remote indication of the barrel orientation and hole characteristics provide signals which are transmitted by electrical cable mounted within a hydraulic line inside the pipe string. The hydraulic and electric conduits are supported within the pipe string by shock mounts fixedly attached to the hydraulic conduit.

BRIEF DESCRIPTION OF THE DRAWINGS

FIG. 4A is a section through a length of pipe according to a second embodiment of the invention;

FIG. 4B is an end view of a spider employed in the FIG. 4A embodiment, with part of the spider indicated only in phantom;

Figure 1:
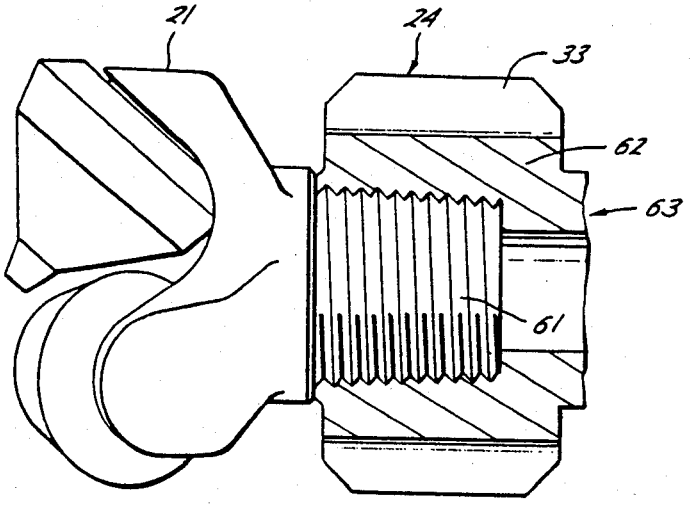
FIG. 1 is an elevation largely in section, showing a drill bit connected to a rate of direction change limiter according to the invention.

DESCRIPTION OF THE PREFERRED EMBODIMENT a. General

Referring now generally to FIGS. 1 through 5, there is shown a drill bit 21 connected by sub 63 to the shaft 23 of an in-hole motor 25. The motor is connected to an instrument package 27 supplied with electrical connections by electrical conduit 28. The motor and drill bit are supplied with fluid through fluid passage or conductor 29 provided by a string of pipe sections 32. Motor 25 is of the fluid turbine type including shaft 23 and housing 31. Fluid for operating the motor and carrying away the drill bit cuttings is supplied via tubular shaft 23 fed by conductor 29. Axial force to the motor housing 31 is supplied by drilling rig 37 (see also FIGS. 9–10) acting on the string of pipes 32 to which it is attached by connector 40. Rig 37 also takes the reaction torque of the in-hole motor 25. Devices supplying axial hole force are known in the art and a typical example thereof is disclosed in U.S. Pat. No. 3,463,252, issued Aug. 26, 1969, to C. E. Miller et al. The axial force on motor housing 31 is transmitted by thrust bearings (not shown) to motor shaft 23 and thus to bit 21.

To direct the drill bit a deflection barrel 41 is provided around the motor 25, the barrel 41 being provided with asymetrically disposed wall engaging means 81, 83 (shoes) to urge the motor and bit to one side of the hole. The wall engaging means 81, 83 are adapted to slide longitudinally along the hole as drilling proceeds. The barrel is rotatable with the motor housing to the desired position by means of connector 40 actuated by the drilling rig 37 through the rigid pipe sections 32.

The rate that deflection barrel 41 can change hole direction is limited by a rotating rate of change limiter 24 fixedly mounted on sub 63 which connects bit 21 to motor shaft 23.

It will be understood that the invention is designed for use in drilling more or less horizontal holes or holes having at least a horizontal component, so that devices such as gravity actuated mercury potentiometers, pendulums or other devices well known in the art may provide an indication of the azimuthal position of the barrel deflection means 81, 83 relative to the hole axis.

b. Rate of Change Limiter

Figure 2:
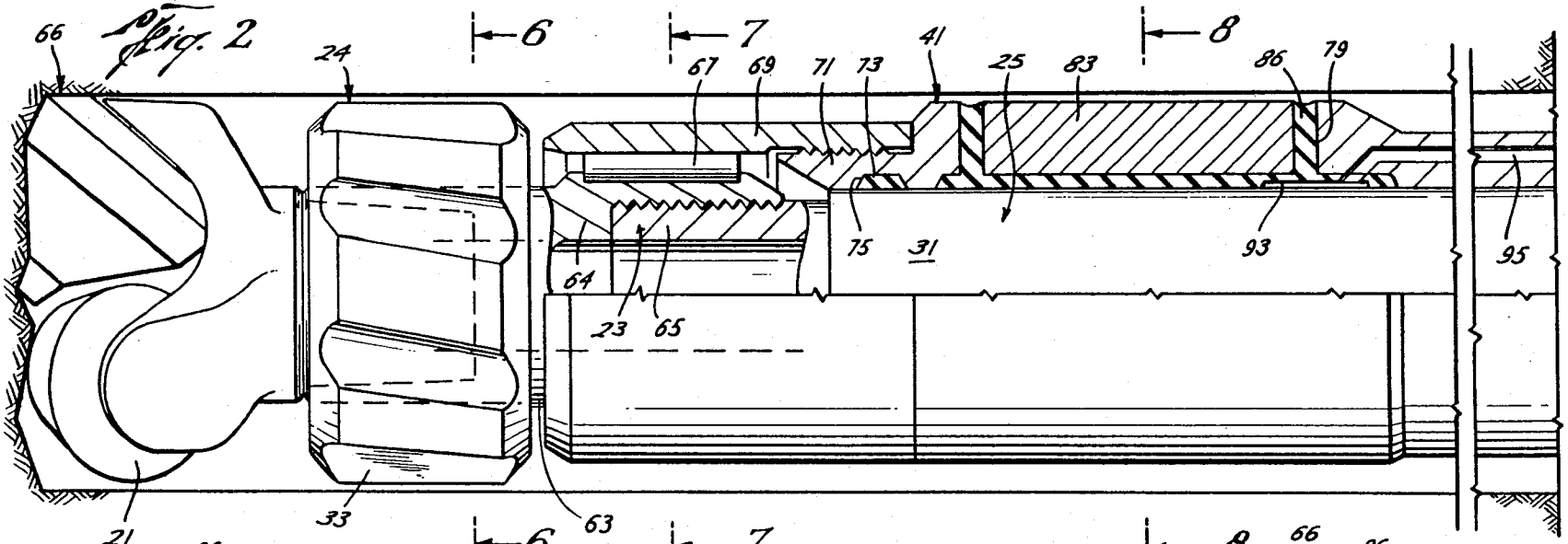
FIGS. 2 through 5 together form a view partly in elevation and partly in section showing an apparatus embodying the invention.
Figure 7:
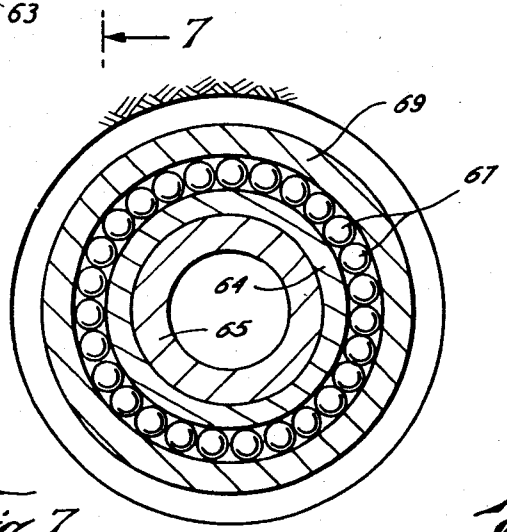
Figure 6:
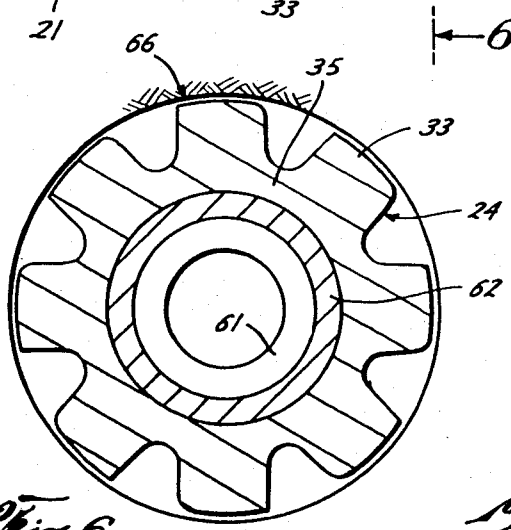
Figure 3:
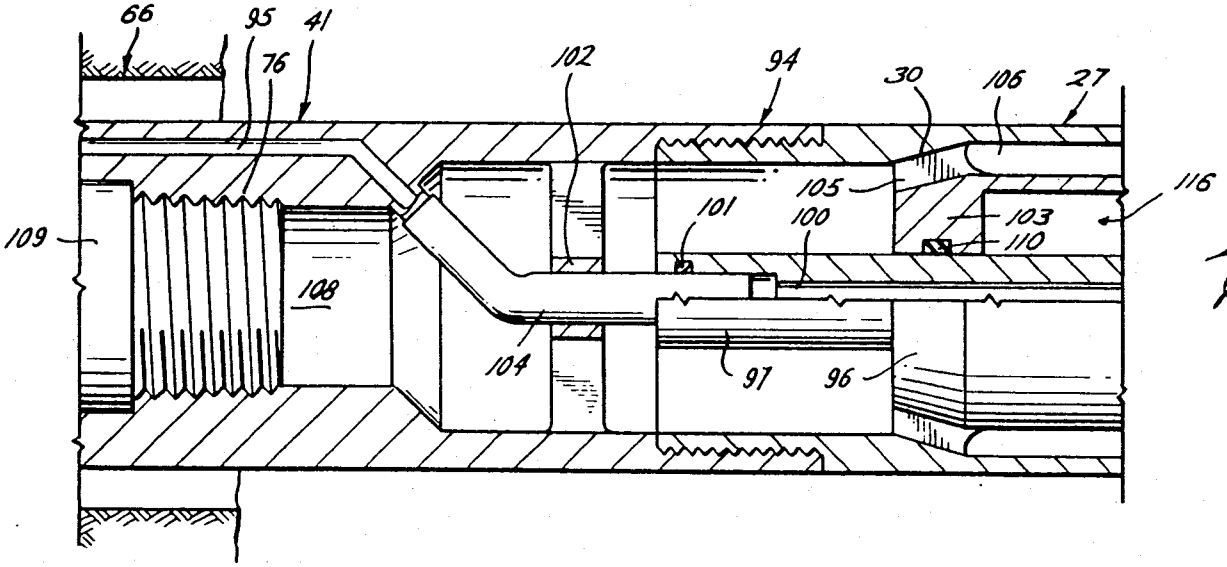

Referring now to FIGS. 1, 2 and 3, there is shown drill bit 21 having a pin 61 screwed into box 62 of sub 63. Box 62 has a rate of change limiter 24 comprising body 35 and fins 33 affixed thereto. The outer diameter of rate of change limiter 24 is less than the diameter of the bore 66 with the difference in diameters controlling the rate of change of the hole direction with bigger differences permitting faster changes in hole direction. Sub 63 has its outer end 64 screwed onto the inner end 65 of motor shaft 23. Heavy, radial load roller bearings 67 (see also FIG. 7) lie between outer end 64 and cuff 69 which is screwed ot the inner end 71 of the deflection barrel 41.

c. Deflection Barrel

Figure 8:
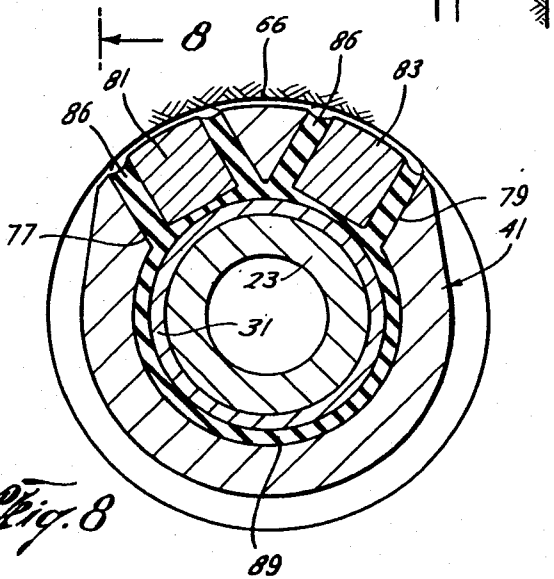
FIGS. 6 through 8 are transverse sections taken through the apparatus shown in FIGS. 2 through 5 at the indicated planes.

Barrel 41 is sealed to motor housing 31 by annular elastomeric seal ring 73 disposed in an annular groove 75 in barrel end 71. Motor housing 31 is attached by shouldered screw connection 76 to deflection barrel 41. Referring also to FIG. 8, two windows 77, 79 in the barrel receive hole wall engaging blocks or pistons 81, 83. Between the pistons and the windows is disposed elastomeric mounting means 86 for sealingly mounting the pistons in the windows and which allows the pistons to be moved outwardly by pressure differential to engage the wall of hole or bore 66, as shown in dotted lines, and which retracts the pistons from wall engaging position, as shown in solid lines.

Fluid for pushing pistons 81, 83 outwardly is conveyed to the slight annular clearance between elastomeric sleeve 89, integral with means 86, and motor housing 31, by annular groove 93 in the sleeve. Fluid is supplied to groove 93 by longitudinal channel 95 cut into deflection barrel 41.

d. Instrument Package

Figure 4:
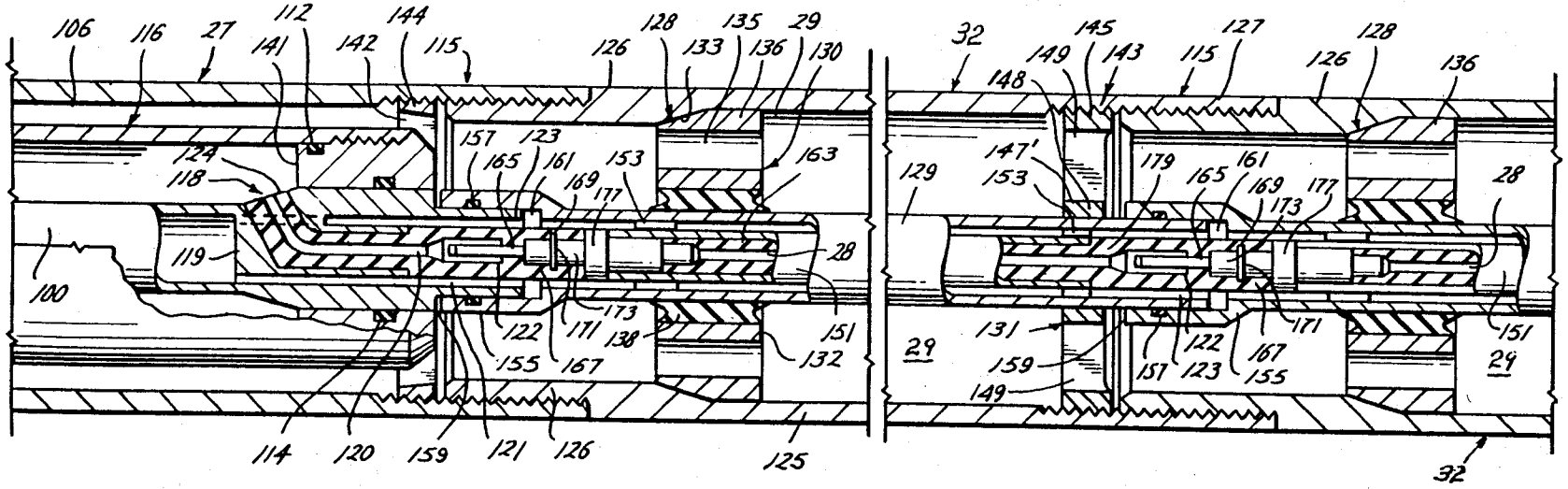
Figure 5:
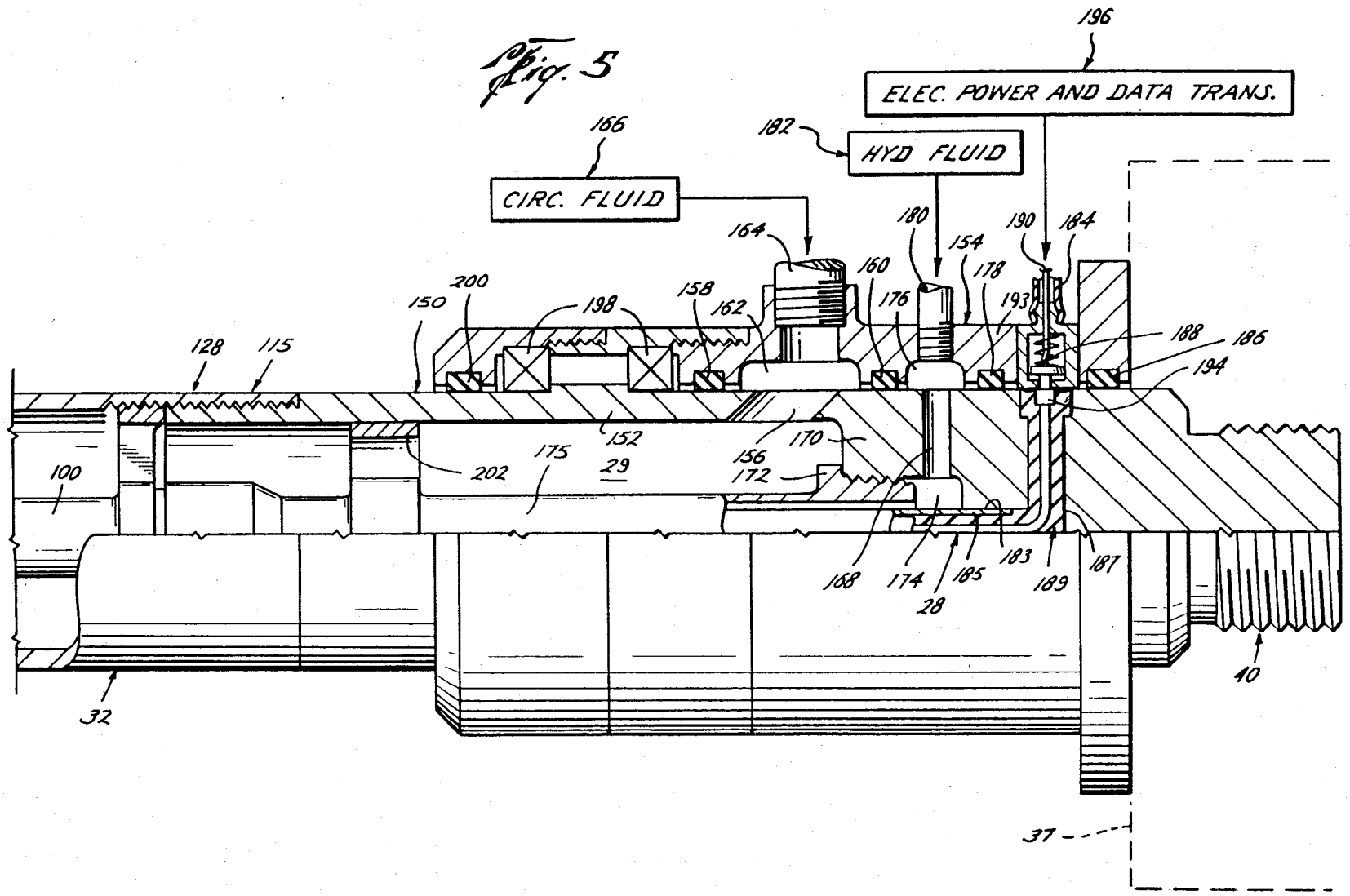

Referring now to FIGS. 3 and 4, instrument package or tube 27 includes an outer tube 28 connected by shouldered and threaded connection 94 to deflection barrel 41 and by similar connection 115 to pipe section 32. Tube 27 is provided with a tapered shoulder 30 facing the out-of-hole end of the package. An instrument container in the form of a hollow cylinder 116 is coaxially disposed inside tube 27. The in-hole end of cylinder 116 is closed by bulkhead 103, which is beveled at 96, and the bevel is provided with azimuthally spaced ribs 105 which rest against shoulder 30. The outer end of cylinder 116 is closed by a screw plug 141 and sealed by seal ring 112. Screw plug 141 is provided with azimuthally spaced ribs 142. A threaded ring 144 secured to the outer ends of ribs 142 is screwed into threaded box 98 of connection 115. Cylinder 116 is thus held in place within tube 27. The outer diameter of cylinder 116 is smaller than the inner diameter of tube 27 forming an annular fluid passage or channel 106 therebetween communicating through the flow passages formed between the ribs 105 and between the ribs 142 with the spaces inside tube 27 at the ends of the cylinder.

Axially extending through instrument container 116 is a tubular conduit forming hydraulic channel 100. The conduit is sealed by seal rings 110 and 114 to inner bulkhead 103 and the outer bulkhead formed by plug 141. Conduit 100 has a box 97 which is telescopically connected by tube or channel 104 to longitudinal channel 95 in barrel 41. Seal 101 keeps channels 100, 104 in fluid tight flow communication. Spider 102 connects longitudinal channel 104 to deflection barrel 41 and supports it to maintain proper alignment for telescopic connection. Spider 102 contains flow channels between its ribs to permit fluid flow between longitudinal drilling fluid channel 106 and flow channel 108. Flow channel 108 is formed at the entrance to motor shaft 23 to supply fluid from channel 105 via tubular pin 76 in motor stator 109 for powering motor 25 and for flowing through drill bit 21 to wash chips away for return through the annulus between the drill pipe and hole 66.

Instrument container 116 contains instruments (not shown) for determining tool position with relation to the edge of a coal or other mineral seam e.g. as shown in U.S. Pat. No. 3,823,787 to Haworth, so that the tool can be kept in the center of the seam, or for determining the direction and inclination of the hole, such as a three axis magnetometer or a compass and inclinometer known in the art of oil well surveying, whereby the hole can be kept straight or in other manner directed as desired. If desired, both types of hole responsive instruments can be used in the container. In any event the container will also include means for determining the azimuthal position of the deflection barrel, such as the mercury potentiometer described in co-pending U.S. application of Jackson M Kellner Ser. No. 584,736 filed June 9, 1975, entitled Drill Director.

e. Instrument Package Connection to Pipe Section

Referring now to FIG. 4, instrument package 27 is connected by threaded and shouldered connection 115 with pipe section 32 forming part of a string of pipe extending to out-of-hole drill rig 37. Section 32 is the same as all of the other pipe sections 32 of the pipe string so that only one need be described, as will be done in more detail hereinafter. As many pipe sections 32 are used as necessary to extend the pipe string from instrument package 27 to the mouth of the hole.

The instruments in instrument container 116 terminate in conductor means 118. Conductor means 118 includes a cable bundle of conductors 120 surrounded, insulated and sealed by rubber 124. Conductor means 118 extends radially through the side of tube 100 and into a position coaxial within hydraulic channel or tube 100 and is held concentrically therein by mount 119, leaving flow annulus 121 for flow of hydraulic fluid. Conductors 120 terminate in female banana connector 122. Insulator 167 of female electrical connector 122 extends beyond the pin end 123 of tube 100 that extends out from screw plug 141 of the instrument container. Electrical connector 122 and pin 123 of the hydraulic tube are adapted to mate with correlative members on the adjacent one of pipe sections 32.

f. Pipe Section

Each pipe section 32 includes an outer tube 125 having a cylindrically threaded pin 126 at one end and a cylindrically threaded box 127 at the other end for making rotary shouldered connections with correlative members on adjacent pipe sections. For details of rotary shouldered connections see U.S. Pat. No 3,754,609 to W. R. Garrett. Near its pin end the outer tube has an internal, tapered shoulder 128 facing toward its outer end. An other tube 129, providing a continuation of hydraulic fluid channel or tube 100, is disposed concentrically within outer tube 125 and is positioned centrally and axially by spiders 130 and 131. Spider 130 includes a disc 132 having a bevelled outer periphery 133 adapted to seat on shoulder 128. Disc 132 is provided with a plurality of fluid passages or ports 135. The inner periphery of disc 132 is secured to the outer periphery of the tube 129 by a resilient sleeve 138. Sleeve 138 has a lower modulus of elasticity than that of tubes 125, 129, and disc 132, which typically are made of metal, usually steel. Preferably sleeve 138 has an elastic modulus of between 100,000 and 250,000 pounds per square inch. Sleeve 138 is preferably made of rubber or other elastomeric material having a durometer hardness of between 40 and 90 on the Shore A scale. Spider 131 at the out hole end of pipe section 32 includes threaded ring 145 rigidly mounted to hub 147 by azimuthally spaced ribs 149 leaving fluid passages between the ribs. Hub 147 fits snugly over a terminal portion 123 of 129 and, as shown at 148, is welded thereto. As described below, terminal portion 123 functions as a connector similarly to pin end 123 of tube 100, for which reason it has been given a like reference number. Tube 129 is assembled within tube 125 by inserting it through box 127 until bevel 133 seats against shoulder 128, this being accomplished finally by rotation, to screw ring 145 into box 127. Alternatively, as shown in FIGS. 4A and 4B, ring 145 could be unthreaded, slipped into box 127, and welded thereto. Since except for the substitution of a weld for the threads the construction is the same as that of FIG. 4, like reference numbers having been employed for like parts. Elastomeric sleeve 138 allows for relative rotation, turning or twisting, and elongation and contraction between outer tube 125 and the other tube 129. If this is insufficient, spider 131 can be constructed with an elastomeric portion the same as spider 132. Sleeve 138 provides also a damper for torsional and axial vibrations.

Within tube 129 is disposed an inner tube 151. Tube 151 has fins 153 secured to its outer periphery and to the inner periphery of intermediate tube 129, e.g. by epoxy cement. Fins 153 between the inner and intermediate tubes at one end of the tubes can be unattached to the inner or intermediate tube to permit relative motion of the tube ends. An annular fluid passage is thus formed between the intermediate and inner tubes, the space between the fins providing fluid passages from one side of the fins to the other. A box 155 on the in-hole end of the intermediate tube 129 telescopically receives pin 123 on the end of tube 100 in the instrument package or a like pin 123 on the end of tube 129 of another pipe section 32. A seal ring 157 received in a groove in box 155 seals with pin 123 while allowing relative rotation and relative axial motion, there being no shoulder or end engagement between the pin and box to prevent such axial motion, there being instead clearance at 159, 161 when connection 115 is made up tight.

Electric conduit or cable 28 extends axially through inner tube 151, being insulated therefrom by rubber sleeve 163, the same as cable 120 is insulated by rubber sleeve 124. The rubber sleeve fits tight enough in tube 151 to retain cable 28 therein. At the in-hole end of cable 28 there is a pin connector 165 adapted to connect with box connector 122 at the end of cable 120 or at the end of a like connector on the out hole end of another pipe section 32. A pocket formed by extension 167 of the rubber insulation around box 122 has an internal groove 169 adapted to snap over an annular rib 171 at the base 173 of pin 165 to keep the electrical connection together. This snap together occurs as the threaded connection 115 on the outer tube is made up tight. A connection of this type is known as a bulkhead connection, one form of which is available from Vector Manufacturing Company, Houston, Tex.

It will be noted that inner tube 151 extends to radial flange 177 adjacent base 173 of pin connector 165 but terminates short of the end of rubber sleeve 163 at the out hole end of the sleeve, leaving the thickened end 179 of the sleeve externally unsupported. This allows for rubber flow sufficient to permit twisting and axial motion of pin 165 relative to box 122. In this regard it will be noted that in FIG. 4 the end of pin 165 does not bottom in box connector 122; in other words, the distance from the end of pin 165 to rib 171 is less than the distance from the bottom of connector 115 to groove 169.

g. Swivel

Pipe sections 32 may be strung for thousands of feet and terminate at interface section 150 (FIG. 5) whose out-hole end provides the outermost stem 152 of hydraulic pneumatic triple swivel 154. Swivel 154 includes a body 193 within which stem 152 is rotatably received. Stem 152 includes channel 156 in fluid tight flow communication with annular chamber 162, the latter being sealed by seals 158, 160. A port in the body connects chamber 162 with a pipe 164 leading to drill fluid pump 166. A block 170 closing the end of stem 152 includes a channel 168. Channel 168 permits fluid tight flow communication between socket 174, into which pin 172 on intermediate stem 175 of the swivel is screwed, and annular chamber 176 of the swivel body. Chamber 176 is sealed by seals 160 and 178. It is connected by pipe 180 with hydraulic fluid source 182.

Block 170 has a smooth socket 183 receiving the out-hole end of inner stem 185 within which is disposed a continuation of electric cable 28. A radial passage 187 in block 170 receives electrical conductor riser 189, electrically coupling conductor cable 28 with electrical pick-offs 184 of swivel connector 154. Electrical pick-offs 184 are sealed by seals 178 and 186 and include springs 188 engaging pick-off wires 190 to annular slip ring terminals 194 of electrical conductor riser 189. Wires 190 are terminated at electrical power and data transmission apparatus 196 which includes indicators and controls. Thrust bearings 198 permit terminating stem 152 to be rotatably engaged within swivel body 193. The space surrounding bearings 198 is sealed by seals 158 and 200. Block 170 terminates at screw coupling 30 which connects to drill rig 37 to be rotated to position pistons 81, 83 azimuthally relative to the hole while leaving the swivel body 193 in a fixed position.

Intermediate stem 175 is supported within outer stem 152 by spider 202 affixed to the intermediate stem and slipped into the outer stem, being otherwise similar to spider 131. The in-hole ends of the swivel stems terminate in threaded, telescopic, and bulkhead connections the same as on pipe sections 32, thereby to connect the swivel stems with the pipe sections. The annulus between the outer and inner stem provides a flow passage communicating with the flow passage between the outer and intermediate tubes of the pipe sections, the annulus between the intermediate and inner sleeve providing a flow passage communicates with the flow passage between the intermediate and inner tubes of the pipe sections, and the electric cable in the inner stem connecting to the electric cable in the inner tube of the pipe sections.

h. Drill Rig

Figure 9:
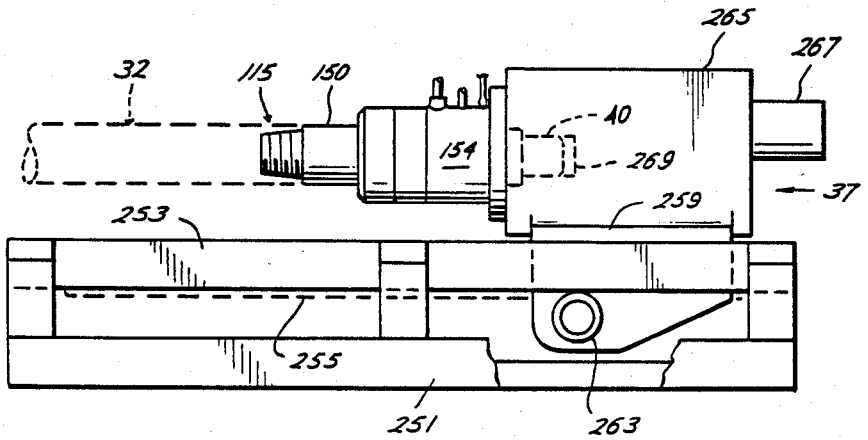
FIGS. 9 and 10 are schematic views of a rig constituting the out hole force applicator and azimuthal orientation apparatus for turning the pipe string and applying axial force thereto.
Figure 10:
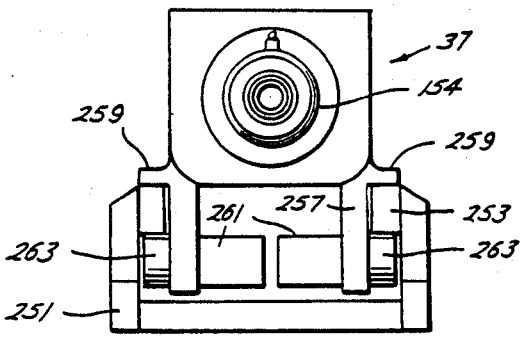

Referring now to FIGS. 9 and 10, there is shown the out-hole apparatus or rig 37 for turning the pipe string azimuthally about its axis as may be desired to position the deflection barrel and for advancing and retracting the pipe string axially in the hole as may be desired, e.g. for loading the drill bit axially or for withdrawing the drill string in whole or in part to change bits or add pipe sections or to commence or discontinue drilling. Rig 37 includes a frame 251 to be anchored to the earth or having sufficient weight to hold it in place. Mounted on the frame are tracks 253 having downwardly facing rack teeth 255. A movable chassis 257 has slides 259 resting on tracks 253. On the lower part of the chassis are mounted hydraulic motors 261 driving pinions 263. The pinion engage tracks 253 so that when the motors are rotated the chassis 257 is driven forward or backwards along the tracks.

On top of the chassis 257 is disposed a gear box 265 driven by hydraulic motor 267. The output shaft 269 of the gear box is screwed to pin 40 on the out-hole end of the outermost stem 150 of the swivel 154 (see also FIG. 5). The pin on the in-hole end of swivel stem 152 is connected to the box of the outer tube of the adjacent pipe section 32. When motor 267 drives the gear box, the string of pipe sections 32 is turned azimuthally about is axis.

i. Operation

During drilling motor 25 turns bit 21 to bore hole 66. Instruments in container 116 transmit signals out of the hole via cable 28 to tell the operator if the hole is going in the desired direction. If not, the string of pipes 32 is turned by rig 37 through swivel stem 152 until deflection barrel 41 is in an azimuthal position that will redirect the bit in the proper direction. The azimuthal position of the barrel is known from electric signals transmitted out of the hole via cable 28. When the hole is going in the right direction, the deflection barrel may be deactivated by reducing the pressure therein, allowing the deflection pistons or shoes 81, 83 to retract.

j. Modifications

Although the system as described above in detail is believed to be most satisfactory and preferred, different applications and many variations in its elements and the structure of its elements are possible. For example, an electric in-hole motor may be used. Moreover, out-hole torque detection means may be employed to detect the contacting of the rate of change limiter 24 with the hole which would indicate the desirability of letting off pressure on deflection pistons 81, 83.

The above are, of course, merely exemplary of the possible changes and variations.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed as invention is:

1. Multiple conduit pipe comprising a first member including connector means at each end for making connection with correlative connector means on the like members of like pipe to be connected to the ends of said first member, first fluid passage means providing for fluid passage through said first member from one end of the first member to the other all the way through the first said connector means to place said first fluid passage means in fluid flow communication with the like fluid passage means through like members of like pipes when connected to the ends of said first member, said first member and said first fluid passage means comprising a first tube with tubular telescopic pin and box connector means at the ends thereof, a second member including further connector means at each end for making connection with correlative connector means on the like members of like pipe to be connected to the ends of said second member, said second member and said further connector means comprising a second tube with tubular, shouldered, threaded, pin and box screw means at the ends thereof, said second tube and screw connector means being disposed concentrically about said first tube and telescopic connector means respectively, outer diameters of said first tube and the first said connector means being smaller than the inner diameters of said second tube and said further connector means respectively, with second fluid passage means formed therebetween extending from one end of the pipe to the other to place said second fluid passage means in fluid flow communication with like fluid passage means through like pipes when said further connector means at each end of said second member are connected to correlative connector means of such like pipes, said telescopic connector means being free of rigid shoulders that will abut rigid shoulders on correlative telescopic connector means of like pipes when said shouldered screw connector means are made up fully with correlative screw connector means of like pipe, first positioning means extending between the first and second members rigidly connecting one end of the first member to the adjacent one end of said second member, and second positioning means extending between the first and second members elastomerically restraining the other end of the first member relative to the adjacent other end of said second member, both of said members being integral between said first and second positioning means, whereby because of said first positioning means rigidly connecting said first and second members, said first member cannot rotate without limit nor move axially without limit relative to said second member at said second positioning means, but said second positioning means, being elastomeric, allowing for a certain amount of relative rotation, turning, and twisting between said members thereat, said second positioning means independent of said first positioning means allowing only a limited amount of axial movement of said other end of the first member away from said one end of the second member.

2. Pipe according to claim 1, including an elongated interior member extending the length of the pipe, and mounting means concentrically mounting said interior member within said first member, said interior member having a smaller outer diameter than the inner diameter of the tube and connectors that form said first member, leaving an annular space therebetween providing said first flow passage means, said mounting means being unattached to one of said first and interior members at one end thereof to permit relative motion of the last mentioned ends of said first and interior members, said interior member including at said one end further elastomeric means to contact the other end of the interior member of like pipe made up with the first mentioned pipe whereby when said pipe is made up with like pipe at said one end, said further elastomeric means will allow said relative motion of said first and interior members.

3. Multiple conduit pipe comprising a first member including first connector means at each end for making connection with correlative connector means on the like members of like pipe to be connected to the ends of said first member, first fluid passage means providing for fluid passage through said first member from one end of the first member to the other all the way through the first said connector means to place said first fluid passage means in fluid flow communication with the like fluid passage means through like members of like pipe when connected to the ends of said first member, said first member and said first fluid passage means comprising a first tube with tubular telescopic pin and box connector means at the ends thereof, a second member including further connector means at each end for making connection with correlative connector means on the like memebers of like pipe to be connected to the ends of said second member, said second member and said further connector means comprising a second tube with tubular, shouldered, threaded, pin and box screw connector means at the ends thereof, said second tube and screw connector means being disposed concentrically about said first tube and telescopic connector means respectively, the outer diameters of said first tube and first said connector means being smaller than the inner diameters of said second tube and said further connector means respectively, with second fluid passage means formed therebetween extending from one end of the pipe to the other to place said second fluid passage means in fluid flow communication with the like passage means through like pipes when said further connector means at each end of said second member are connected to correlative connector means of such like pipes, and positioning means concentrically positioning the first member within the second member, said telescopic connector means being free of rigid shoulders that will abut rigid shoulders on correslative telescopic connector means of like pipes when said shouldered screw connector means are made up fully with correlative screw connector means of like pipe, said positioning means comprising first and second annularly arranged support means disposed about the first member, said support means each providing fluid passage therethrough forming part of said second fluid passage means, said positioning means including means on at least one of said support means rigidly connecting the outer periphery of the support means to the inner periphery of the second member, the inner peripheries of both said one and the other of said support means being secured to the outer periphery of the first member, the inner periphery of said support means that is on the other of said support means being secured to the outer periphery of the first member by means of an elastomer sleeve extending around and fixedly attached to the first member and forming part of the support means and allowing limited relative axial and rotational motion of the first member relative to the second member thereat, said support means each comprising a metal disc having a plurality of off-axis holes extending transversely therethrough, one of said discs being threaded on its outer periphery and being screwed into said box connector of the second member and being rigidly secured at its inner periphery to said first member adjacent said pin connector of the first member, said second member having on its inner periphery adjacent its pin connector a shoulder facing toward the box connector of the second member, the other of said discs bearing against the last said shoulder, said elastomer sleeve securing the inner periphery of said other disc to said first member, said first member being assemblable within said second member by inserting the first member through said box connector of the second member until said other of said discs bears against said shoulder, the final insertion being accompanied by rotation to screw said one of said discs into said box connector of the first member.

4. Pipe according to claim 3, the last said shoulder being tapered and said other disc having a correlative bevel at its outer periphery.

5. Pipe according to claim 3, including an elongated interior member extending the length of the pipe and means concentrically mounting said interior member within said first member, said interior member having a smaller outer diameter than the inner diameter of the tube and connectors that form said first member, leaving an annular space therebetween providing said first flow passage means.

6. Pipe according to claim 5 said interior member including at one end a metal conector pin, said interior member including at its other end a female connection member including an elastomeric socket adapted to receive such a pin, whereby when said pipe is made up with like pipes at each end, said metal pin and elastomeric socket will resiliently couple said interior member to like members of said like pipes and allow said relative axial and rotatonal motion of said first member.

7. Pipe according to claim 6, said metal connector pin having an annular rib therearound, said elastomeric socket having an annular side wall with an internal groove adapted to snap over such an annular rib, said female connection member having concentrically disposed therein a metal telescopic box connector adapted to coneect with such a metal connector pin.

8. Pipe according to claim 7, including a rubber covered metal cable inside said interior tube frictionally retained therein and connected at its ends to said metal pin connector and telescopic box connector.

9. Pipe according to claim 3, said screw connectors of said second member having straight threads.

10. Pipe according to claim 6, said interior member being mounted within said first member by mounting means rigidly connecting the interior member and first member at one end thereof and leaving the other ends of the interior and first member unattached to permit relative motion of said other ends of the interior and first member as allowed by said elastomeric socket when the pipe is connected to a like pipe adjacent said other ends.

11. A drill string comprising a plurality of lengths of multiple conduit pipe, each length of pipe being in accordance with claim 3, said lengths of multiple conduit pipe being connected together with the pin connector of each second tube screwed into the box connector of the second tube of an adjacent length of pipe in shoulder to shoulder engagement, and the pin connector of each first tube telescoped into the box connector of the first tube of an adjacent length of pipe but with clearance between the pin's end and the bottom of the box to provide room for said limited relative axial motion of the first and second members of each length of pipe allowed by said elastomer sleeve.

12. A drill string comprising a plurality of lengths of multiple conduit pipe, each length of pipe being in accordance with claim 6, said lengths of multiple conduit pipe being connected together with the pin connector of each second tube screwed into the box connector of the second tube of an adjacent length of pipe in shoulder to shoulder engagement, and the pin connector of each first tube telescoped into the box connector of the first tube of an adjacent length of pipe but with clearance between the pin's end and the bottom of the box to provide room for said limited relative axial motion of the first and second members of each length of pipe allowed by said elastomer sleeve, and the metal connector pin of each interior member received in elastomeric socket of the interior member of an adjacent length of pipe providing a resilient coupling allowing said relative axial and rotational motion of the first member of each length of pipe relative to the second member thereof.

13. Multiple conduit drill pipe comprising an inner tube supported within an outer tube by supports adjacent both ends of the inner tube, the supports having openings therethrough providing passages for the flow of fluid therepast, the passage formed by the interior of the inner tube providing a fluid conduit from one end of the drill pipe to the other end of the drill pipe, the passage formed between the tubes forming another conduit from one end of the drill pipe to the other end of the drill pipe, said tubes including connection means at the ends thereof for making connection with correlative connection means at the ends of like drill pipe to form a string of drill pipe, each of said supports including metal engagement means engaging the inner periphery of said outer tube to prevent relative axial motion of the support and outer tube, one of said engagement means preventing such relative axial motion in one direction and the other of said engagement means preventing such relative axial motion in the other direction, both of said supports being fixedly attached to the outer periphery of said inner tube, one of said supports including elastomer means to permit limited relative motion of said outer tube and said inner tube, the other of said supports being made of metal and rigidly connecting the inner tube and outer tube thereat, said connection means at each end of the drill pipe comprising a shouldered threaded connector on said outer tube and a telescopic connector on said inner tube, said connection means at one end of the pipe being correlative to those at the other end of the pipe and including a pin telescopic connector at one end of the inner tube and a box telescopic connector at the other end of the inner tube, said connection means at each end of the outer tube providing for limited make up with correlative connection means on similar pipe, and said connection means at each end of the inner tube providing for limited relative axial motion of the tube at that end when said connector means on the outer tube are fully made up with such correlative connector means on similar pipe as allowed by the elastomer means in said one of said supports of the inner tube within the outer tube.

14. Pipe according to claim 13, said outer tube having an internal shoulder on its inner periphery adjacent one of said connector means, one of said supports including an outer peripheral portion engaged with said shoulder.

15. Pipe according to claim 13, said connection means of the outer tube including a threaded pin at one end of the tube and a correlative threaded box at the other end of the tube adapted to receive a correlative threaded pin like the first said threaded pin but on the end of another length of pipe, one of said supports including a threaded portion screwed into said box, said box being deep enough to receive both said threaded portion of said support and such correlative threaded pin.

16. Pipe according to claim 15, said threaded pin and box and said threaded portion of said one of said supports all being straight threaded.

17. Pipe according to claim 13 including an interior tube centrally supported within said inner tube in radially spaced relationship, a rubber covered metal cable inside said interior tube frictionally retained therein, and correlative bulkhead connectors on the ends of said cable.

* * * * *

UNITED STATES PATENT AND TRADEMARK OFFICE

CERTIFICATE OF CORRECTION

PATENT NO. : 4,522,234

DATED : JUNE 11, 1985

INVENTOR(S) : JACKSON M. KELLNER, WILLIAM R. GARRETT

It is certified that error appears in the above—identified patent and that said Letters Patent is hereby corrected as shown below:

Column 1, line 49: change ";" to -- . --.

Column 1, line 58: delete "See. U.S. Pat. No. 3,088,532."

Column 3, line 17: change "ot" to -- to --.

Column 4, line 50: change "insulator" to -- insulation --.

Column 5, line 17: before "129" insert -- tube --.

Column 5, line 64: change "pocket" to -- socket --.

Column 7, line 23: change "150" to -- 152 --.

In the Claims

Claim 3, column 9, line 36: change "memebers" to -- members --.

Claim 3, column 9, line 59: change "corresla-" to -- correla- --.

Signed and Sealed this

*Fifteenth* Day of *October 1985*

[SEAL]

*Attest:*

*Attesting Officer*

DONALD J. QUIGG

*Commissioner of Patents and Trademarks—Designate*